United States Patent [19]

Robeller

[11] 4,067,664

[45] Jan. 10, 1978

[54] CONTROL SYSTEM FOR A PUMP

[75] Inventor: Walter Robeller, Boblingen, Germany

[73] Assignee: Robert Bosch GmbH, Stuttgart, Germany

[21] Appl. No.: 629,545

[22] Filed: Nov. 6, 1975

[30] Foreign Application Priority Data

Dec. 31, 1974 Germany ..... 2461897

[51] Int. Cl.[2] ..... F04B 1/26

[52] U.S. Cl. ..... 417/218

[58] Field of Search ..... 417/212, 218, 219, 222

[56] References Cited

U.S. PATENT DOCUMENTS

| | | | |
|---|---|---|---|
| 3,067,693 | 12/1962 | Lambeck | 417/219 |
| 3,296,797 | 1/1967 | Tlusty | 60/450 |
| 3,495,536 | 2/1970 | Fahey | 417/218 |
| 3,679,327 | 7/1972 | Riedhammer | 417/222 |
| 3,768,928 | 10/1973 | Miller | 417/222 |
| 3,809,500 | 5/1974 | Staudenrausch | 417/222 |
| 3,820,920 | 6/1974 | Klimaszewski | 417/218 |
| 3,856,436 | 12/1974 | Lonnemo | 417/212 |
| 3,946,561 | 5/1976 | Reidhammer | 417/212 |
| 3,959,969 | 6/1976 | Tittmann | 417/212 |

*Primary Examiner*—William L. Freeh
*Attorney, Agent, or Firm*—Michael J. Striker

[57] ABSTRACT

The pump has a regulating element whose position is controlled by means of a first and second piston. The first piston is kept under pressure by the output pressure of the pump. The output side of the pump is also connected to a throttle valve which has a cross-section allowing fluid flow which varies as a function of pressure. The pressure difference created at the throttle valve output relative to the throttle valve input acts on a three-position three-port control valve which control the pressure on the second piston accordingly. The second piston has a larger diameter than the first piston.

7 Claims, 3 Drawing Figures

CONTROL SYSTEM FOR A PUMP

BACKGROUND OF THE INVENTION

This invention relates to control arrangements for adjustable pumps. In particular it relates to such control arrangements where it is desired that the product of the lifting pressure times the flow be kept constant, independent of the driving speed of the pump. A throttle valve is arranged in the conduit communicating with the output side of the pump. Further, the pump has a regulating element which is acted upon by two pressure-loaded pistons.

This type of regulating system is also known as a power control system and the product of lifting pressure times quantity of liquid pumped is held constant by arranging a lever on which acts a control spring from the one side while the lifting pressure is applied to the other side by means of a piston. The lever then controls a piston which in turn controls the regulating element of the pump. For increasing lifting pressures, the quantity of liquid is decreased and vice versa. An exact hyperbolic characteristic curve can be created with such a control system, but only the starting torque of the pump is held constant while the delivered hydraulic power may vary in dependence with the speed of the pump.

Other regulating systems are known which do manage to maintain the delivered hydraulic power constant. Here a spring and a piston interact with a lever, the spring being adjusted to represent the desired power output, while the piston delivers a pressure corresponding to the lifting pressure of the pump. Of course a mechanical root extracting element must be furnished in order to equalize the two dimensionally unequal quantities. This type of regulating system is therefore very complicated, expensive and subject to malfunction.

SUMMARY OF THE INVENTION

It is an object of the present invention to furnish a control system which causes the delivered output of a pump to remain constant while utilizing relatively simple inexpensive elements.

This invention is a control system for a pumping system having an adjustable pump having a regulating element acted upon by first and second pressure loaded means. The output side of the pump is connected to a throttle valve means which has a variable cross-section. The cross-section of said throttle valve means varies as a function of the lifting pressure. The pressure difference created by said throttle valve means is applied to a control valve means which controls the pressure applied to the second pressure loaded means as a function thereof. The first pressure loaded means is pressure loaded by the pressure at the output side of the pump.

The present system utilizes a small number of generally commercially available elements to keep the hydraulic output of the pump constant at a desired value and independent of the pumping speed. Further, a relief valve may be provided in order to limit the maximum lifting pressure of the pump.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawints.

DESCRIPTION OF THE PREFERRED EMBODIMENTS

Figure 1:
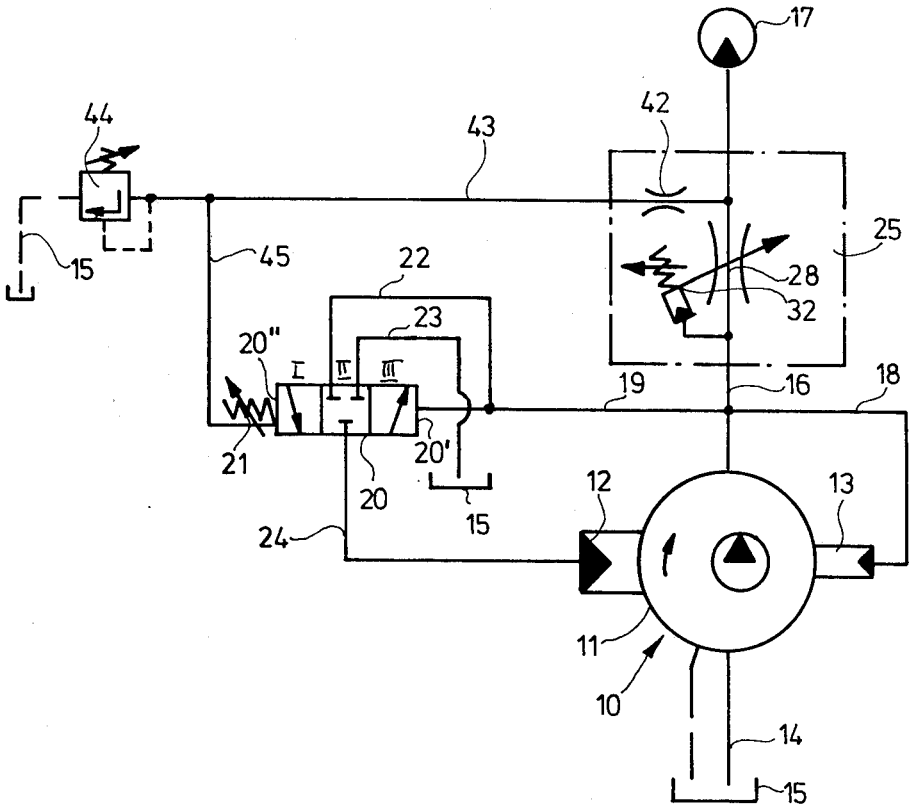
FIG. 1 is a schematic diagram showing the control system of the present invention.

A preferred embodiment of the present invention will now be described with reference to the drawing.

FIG. 1 shows an adjustable pump 10 having a regulating element 11 which regulates the length of the pump stroke. Regulating element 11 operates under control of first and second pressure loaded means namely a piston 12 and a piston 13. Piston 13 has a smaller diameter than piston 12. Pump 10 lifts liquid through a conduit 14 from a container 15 and lifts it to a conduit 16 which leads to a load 17.

A first control conduit 18 branches out from conduit 16. Conduit 18 leads to piston 13 and further communicates with another control conduit 19. One face 20' of control valve means 20 is acted upon by the liquid pressure in conduit 19 while the other face 20'' is acted upon by a control spring 21 whose initial tension is adjustable. Control valve 20 is a three-position three-port valve. A branch conduit 22 is connected between conduit 19 and one port of control valve 20. Further, a second port is connected through a conduit 23 to the receptacle 15 which contains the liquid. The third port of control valve 20 is connected to a control conduit 24 communicating with the chamber housing piston 12.

Figure 2:
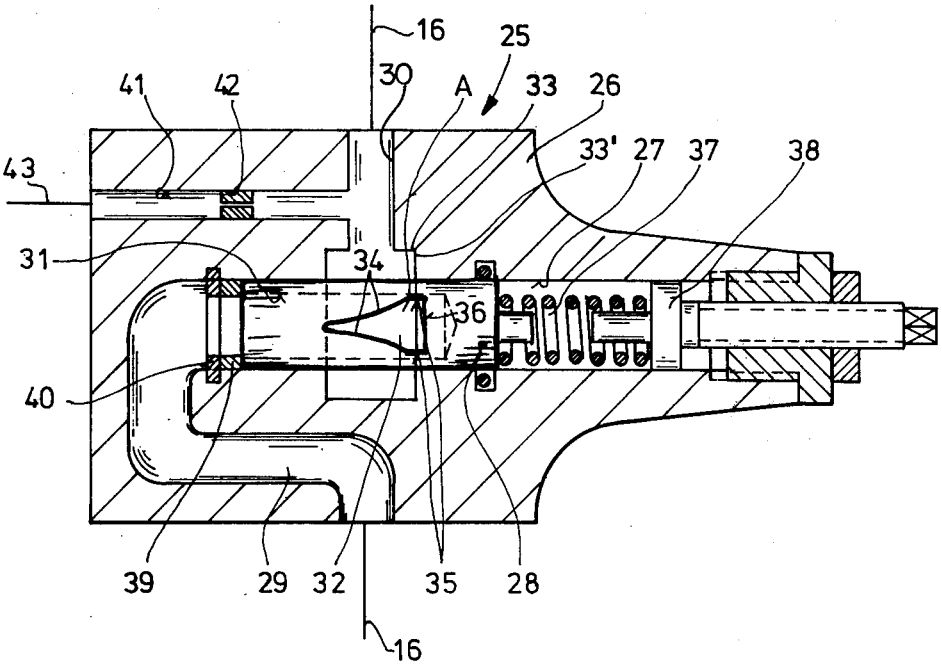
FIG. 2 is a lengthwise cross-sectional view of the throttle valve shown in FIG. 1.

The box indicated by dashed lines represents a throttle valve 25, herein referred to as throttle valve means, and shown in cross-section in FIG. 2. As shown in FIG. 2, throttle valve 25 comprises a housing 26 which has a bore 27. A spool 28 is slidably mounted in bore 27 in a tight fit. A bore 29 terminates in one side of bore 27 while a bore 30 in an exit conduit extends from the lengthwise side of bore 27. Bores 29 and 30 correspond to line 16 in FIG. 1, that is all the liquid pumped by pump 10 enters into bore 29.

Spool 28 has a blind bore 31 into which the liquid enters. The liquid leaves through a slot 32 which is formed in the wall of the piston and communicates with bore 30. Bore 30 does not communicate with bore 27 directly but enters via an annular tee slot 33. Tee slot 33 has a control face 33' which cooperates with slot 32. Slot 32 is approximately of triangular shape but has slightly inwardly curved lengthwise sides 34 which terminate in two short straight portions 35 which end at the base 36 of the slot. The base 36 of the slot extends in a direction perpendicular to the lengthwise axis of the spool 28. A control spring 37 acts on spool 28. The control spring 37 abuts against an abutment 38 on the side not in contact with spool 28. The end of spool 28 not in contact with spring 37 abuts against a ring 39 which abuts against a snap ring 40. The distance between base 36 of slot 32 and the control face 33' of tee slot 33 varies as a function of the thickness of the ring 39. The cross-section of the bore 31 in servo piston 28 which allows fluid to flow through slot 32 to tee slot 33 is designated by the letter A. A bore 41 in which is positioned a fixed throttle 42 communicates with bore 30 and is arranged in the direction perpendicular thereto. A conduit 43 is connected to bore 41. A relief valve 44, herein referred to as pressure limiting means, is disposed in conduit 43. The relief valve 44 is connected to receptacle 15. A conduit 45 extends from conduit 43 at a location prior to the relief valve and terminates at the face 20'' of control valve 20.

All the liquid lifted by pump 10 flows over conduit 16 to spool 28 and through the slot 32 in spool 28 to bore 30 and further through conduit 16 to the load 17. Depending upon the lifting pressure, spool 28 is moved a greater or a lesser distance against the force of spring 37. As the spool 28 moves toward the right, as viewed in FIG. 2, the open cross-sectional area of slot 32 is decreased. Thus, a pressure difference is created between the pressure in conduit 30 and the pressure in conduit 29.

The lifting pressure, that is the pressure at the output side of the pump, is directly applied through conduit 19 to one face 20' of the control valve 20, while the pressure at the output side of the throttle valve is applied through bore 41 and throttle 42 as well as conduits 43 and 45 to the opposite face 20'' of the control valve 20. The equilibrium position of the control valve 20 is maintained by spring 21 acting against the force created by the pressure difference. For this equilibrium position, the pressure created at piston 12 of pump 10 is such that the regulating element 10 causes the quantity of liquid pumped by the pump to correspond to the pressure difference in throttle valve 25. If the pressure at load 17 increases and therefore the hydraulic output increases the cross-section A created by the interaction of the slot 32 in the spool 28 with the control face 33' is decreased so that a greater pressure difference results. This causes control valve 20 to be moved to position III against the force of spring 21. In position III, the liquid drains from piston 12 through conduit 23 into receptacle 15. Since piston 13 is always subjected to the pressure at the output side of the pump, this piston causes the pump to be adjusted to smaller liquid quantities until the pressure difference again corresponds to the equilibrium position of control valve 20.

If the pressure decreases at load 17, the pressure difference at slot 32 decreases and the cross-section A is increased. Correspondingly, control valve 20 is moved into its position I causing liquid to flow through conduits 43, 45 and 24 to piston 12 thereby causing the pump flow rate to increase. This is possible since piston 12 has a larger diameter than piston 13. If the desired value as furnished by control spring 37 has been reached, the control valve 20 will return to its neutral position II, and regulating element 11 of the pump is locked in position hydraulically.

If the speed of pump 10 changes, the pressure difference created by throttle valve 25 also changes, initiating the above-described control sequences.

If the pressure at load 17 increases over the pressure defined by relief valve 44, this relief valve opens causing pressure medium to flow through conduit 43 to receptacle 15. The resulting pressure difference created by throttle 42 is applied to control valve 20 and moves the valve in opposition to the action of spring 21. Again, pressure medium is drained from piston 12 and the amount of fluid lifted by the pump is decreased to such an extent that the pressure in the system is maintained. This of course is a pressure-limiting process.

Figure 3:
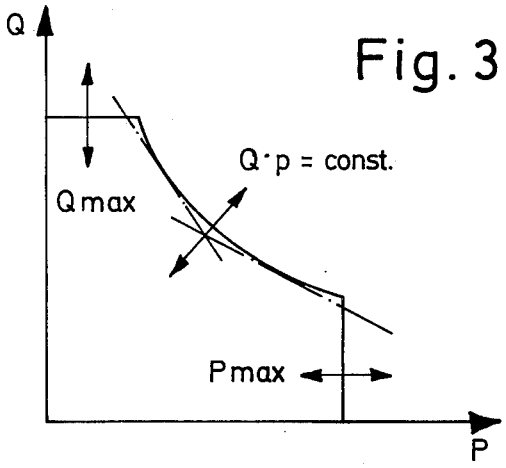
FIG. 3 is a curve of fluid flow versus lifting pressure.

The characteristic lines which apply to the above-described arrangement is shown in FIG. 3. The lifting pressure is entered on the abscissa, the fluid-flow on the ordinate. The limiting value of fluid-flow is a function of the maximum cross-sectional area of slot 32 which can of course be changed in dependence upon the thickness of ring 39. The maximum pressure is defined by check valve 44. The function $Q.p$ is generated by the shape of slot 32. For an exact hyperbola the cross-section A must be proportional to $1/p$ where $p$ is the lifting pressure. The slot then has the shape indicated in FIG. 2, that is, it is substantially triangular but has somewhat inwardly curved sides. The hyperbola shape may be approximated if the two side edges are made straight edges. This is easier to produce commercially. The resulting characteristic curve is shown in dashed lines in FIG. 3 that is, two intersecting straight lines are produced which subtend an obtuse angle. The position of the characteristic curve can be varied over a limited region by changing the initial tension in spring 37.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a pumping system including an adjustable pump furnishing a pumping pressure and a flow at an output side and having a regulating element for adjusting said flow and first and second pressure controlled pistons for adjusting said regulating element, in which said second piston has a diameter larger than said first piston, a control system for maintaining the product of said pumping pressure times flow constant, comprising, in combination, throttle valve means having a throttle valve inlet connected to the output side of said pump, a throttle valve outlet, and a cross-sectional flow area varying as a function of said pump pressure, for creating a pressure difference between said throttle valve inlet and said throttle valve outlet, said pressure difference increasing with the decrease of said cross-sectional area; additional throttling means connected to said throttle valve means and having a constant cross-section; pressure limiting means connected to the output side of said additional throttling means; means for applying said pumping pressure to said first pressure controlled piston; control valve means for varying the pressure acting on said second pressure controlled piston as a function of a pressure difference applied to said control valve means; and means for applying said pressure difference created by said throttle valve means and said additional throttle means to said control valve means.

2. A system as set forth in claim 1, further comprising a first and second chamber respectively accommodating said first and second piston and a first and second conduit respectively communicating with said first and second chamber; and wherein said control valve means is interposed between said first and second conduit.

3. A system as set forth in claim 2, further comprising receptacle means for holding liquid; and wherein said second chamber communicates with said receptacle means under control of said control valve means.

4. A system as set forth in claim 1, wherein said flow-through cross-section decreases in accordance with a hyperbolic function of the pressure difference.

5. A system as set forth in claim 1, wherein said throttle valve means comprises a throttle valve having a throttle valve bore, a control spring mounted in said throttle valve bore, a spool slidably mounted in said throttle valve bore with a snug fit and movable against the force of said spring by said pumping pressure, said spool having a slot having a variable cross-sectional area for permitting liquid flow therethrough; an exit conduit having an exit bore, said throttle valve bore having an annular tee section of increased diameter for communicating with said exit bore, said tee section having a control face cooperating with said slot to limit the open cross-sectional area thereof in correspondence to the relative position of said slot to said control face.

6. A system as set forth in claim 5, wherein said spool is formed with a blind bore extending from one end of said spool into the latter, said slot communicating with said blind bore and having a substantially triangular cross-section having a base adjacent said control face, said control spring acting on the other end of said spool.

7. A system as set forth in claim 5, wherein the initial stress in said control spring is adjustable.

* * * * *